United States Patent [19]

Mattarelli

[11] Patent Number: 4,691,462

[45] Date of Patent: Sep. 8, 1987

[54] BREAK-OPEN ACTION FOR SPORTING RIFLES

[75] Inventor: Ennio Mattarelli, Zola Predosa, Italy

[73] Assignee: Dynamit Nobel Aktiengesellschaft, Troisdorf, Fed. Rep. of Germany

[21] Appl. No.: 844,134

[22] Filed: Mar. 26, 1986

[30] Foreign Application Priority Data

Mar. 26, 1985 [IT] Italy ..... 4830/85[U]

[51] Int. Cl.[4] ..... F41C 7/00

[52] U.S. Cl. ..... 42/75.04; 42/73

[58] Field of Search ..... 42/75.01, 75.04, 75.02, 42/75.03, 73

[56] References Cited

U.S. PATENT DOCUMENTS

| | | | |
|---|---|---|---|
| 1,047,690 | 12/1912 | Oliver | 42/75.03 |
| 2,631,398 | 3/1953 | Fantoni | 42/73 |
| 3,540,345 | 11/1970 | Wolfe | 42/75.02 |
| 3,766,677 | 10/1973 | Waddell | 42/75.04 |
| 4,027,416 | 6/1977 | Berbegal | 42/73 |

FOREIGN PATENT DOCUMENTS

| | | |
|---|---|---|
| 1910375 | 5/1971 | Fed. Rep. of Germany . |
| 2550417 | 5/1976 | Fed. Rep. of Germany . |

*Primary Examiner*—Charles T. Jordan

*Attorney, Agent, or Firm*—Antonelli, Terry & Wands

[57] ABSTRACT

A break-open action for sporting rifles comprising a forward part for connection with the at least one rifle barrel, which part can be releasably locked together with a rearward part by snug seats and corresponding fastening elements, and with the rearward part containing lock mechanisms for connection with the rifle stock.

2 Claims, 3 Drawing Figures

BREAK-OPEN ACTION FOR SPORTING RIFLES

BACKGROUND OF THE INVENTION

The present invention relates to the field of art of firearms, especially rifles intended for sporting use for hunting and, respectively, shooting at clay pigeons.

As is known, such rifles, ordinarily firing two cartridges from two barrels in succession, are used by expert and enthusiastic persons who are unbelievably demanding with regard to possibilities of personalization.

Indeed, the finest engravings on the break-open actions or the inlays in the rifle stocks are nothing else but an external appearance, in conjunction with the wish for a personally outfitted and unique rifle, namely not only from an esthetic viewpoint but also, and above all, concerning the ergonomic features of such a rifle along the lines of constituting an ideal extension of the rifle owner's extremities.

A rifle that is "tailor-made" indeed brings a number of advantages for the user since he can handle this rifle with greater naturalness and thus in a more effective way.

One of the most important features of the ergonomic study of a rifle resides in determination of the angle existing between the axes of the barrel and of the rifle stock. This angle permits optical alignment between the shooter's eyes and the sighting device. Obviously, the optimum value for this angle differs in dependence on the physical build of the shooter.

The methods utilized thus far for determining such an angular adjustment provide a standard value predefined by the shape and inclination of the break-open action, i.e. the part of the rifle containing the lock parts and representing the connection member to the rifle stock. Relatively small deviations from this value can be effected subsequently in dependence on the user's requirements by changes in the form of the rifle stock.

It is obvious that such methods cause quite a number of problems, be it with respect to the construction or be it from a practical or economical viewpoint. In fact, the mechanical working of several reference axes (since the break-open action ordinarily consists of one piece or of two welded-together elements) is troublesome and expensive especially because the permitted machining tolerances are very narrow. In addition, two separate series must be manufactured for right-handed and left-handed shooters.

Besides, the modifying work on the rifle stock can prove to be more assiduous than expected since it is not always possible to satisfy the customer's requirements with the first attempt, especially in an area where the psychological sensation of feeling comfortable has a decisive significance, and several comparative tests are needed to attain this sensation.

The present invention has the objective of proposing an improved break-open action for sporting rifles permitting an individual angular setting between the rifle stock and barrel, independently of the fact whether they are intended for a right-handed or left-handed shooter, and without the need arising for the manufacture of a series of differing break-open actions.

The objective has been attained by an improved break-open action for sporting rifles characterized in that a forward part is provided serving for accommodation of the rifle barrel or the rifle barrels which part can be releasably locked together with the corresponding rearward part by additional snugly fitting seatings and associated fastening elements. In this arrangement, the rearward part contains the lock mechanisms and serves for connection with the rifle stock.

BRIEF DESCRIPTION OF THE DRAWINGS

The invention is shown in embodiments in the drawing and will be described in greater detail below with reference thereto, wherein.

Figure 1:
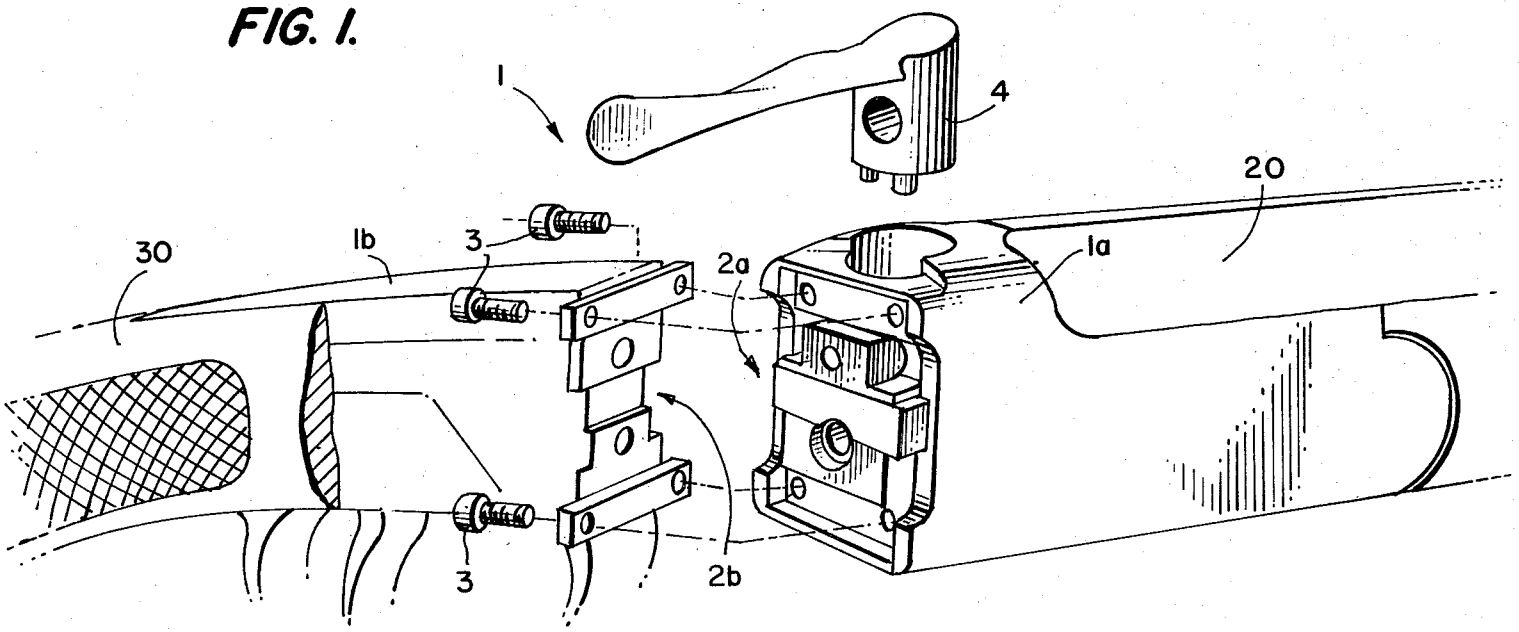
FIG. 1 is a perspective view in exploded representation of the break-open action with the additional elements at the central and end sections.

Referring now to the drawings wherein like reference numerals are used throughout the various views to designate like parts and, more particularly, to FIG. 1, according to this figure, a break-open action generally designated by the reference numeral 1 is mounted by connecting elements lying between the forward part 1*a* and the rearward part 1*b*, with two barrels 20 and the stock 30, respectively, being fitted to the forward part 1*a* and to rearward part, 1*b*, respectively.

The connection is established by two snug seats 2*a*, 2*b* respectively associated with the forward and rearward part 1*a*, 1*b*.

Fastening elements 3 such as, for example socket head cap screws, engage into the forward part 1*a* and rearward cap screws, engage into the forward part 1*a* and rearward part 1*b* in order to tightly join the same to each other. Mutual contact occurs in a zone of the snug seats 2*a* and 2*b*, fashioned as a cross strut at the forward part 1*a* and as a corresponding groove at the rearward part 1*b*, which components fittingly interlock in such a way that a firm support of both parts is achieved not only in the axial or firing direction but also vertically thereto, i.e. in the upward and, respectively, downward directions. The top lever 4 serves, as is conventional, for locking the barrels 20 to the break-open action 1.

Figure 2B:
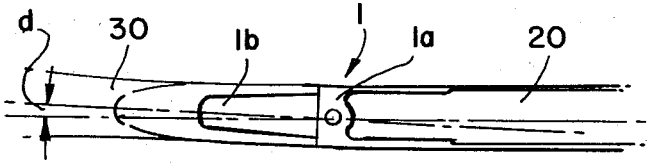
FIG. 2*b* shows the same view as FIG. 2*a* with a rifle stock deflected toward the left.
Figure 2A:
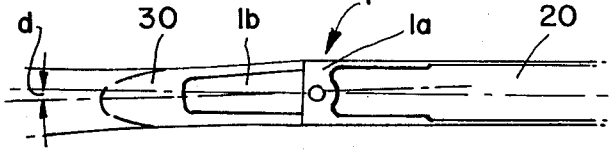
FIG. 2*a* is a schematic drawing of the complete break-open action with a rifle stock deflected toward the right.

FIGS. 2*a* and 2*b* show two joining possibilities with a rightward and leftward deflection of the axis of the stock 30.

The angle d, resulting from the horizontal view, between the longitudinal axes of the forward part 1*a* and, accordingly, the barrels 20, and the rearward part 1*b* and, accordingly, the stock 30, can be varied by an adjustment effected on one contact surface (or also on both contact surfaces) of the snug seats 2*a* and 2*b*.

With the measure of controlled intervention regarding the perpendicularity of the seats 2*a* , 2*b* with respect to the longitudinal axis of the firearms, a connection is obtained by a simple geometrical relationship, with the connection being dependent on the individually desired angle of deflection d between the axes of parts 1*a* and 1*b*.

The above statements reveal with eminent clarity the extreme simplicity of the solution according to this invention, permitting the attainment of an optimum individualization of the deflection angle d in a precise, quick and economical fashion.

The thus-obtained, composite break-open action requires no additional superficial machining, in contrast to those manufactured by welding the end section to the front section wherein permanent deformations are caused by temperature fluctuations, which deformations must be absolutely compensated for since otherwise functioning of the break-open action is impaired.

The uniqueness of the solution of this invention permits various versions of outfitting the rifle with different features. Since the rearward part 1*b* contains the lock mechanisms, it becomes extremely simple to manufacture, depending upon choice, a single-trigger rifle, that is, one trigger for firing both barrels, a double-trigger rifle, that is (one trigger for each barrel, or a selective single-trigger rifle, that is, a single trigger which makes it possible to determine the sequence of shots from both barrels.

Such a property is of special interest for commercial trade since a larger selection can be offered on the market with reduced warehousing.

The possibility of separating the forward and rearward parts from each other furthermore permits a normal servicing of the rifle in a quick and easy fashion without the need for special tools, and also offers the advantage to ship, if necessary, one of the parts away for repair without being subject to the security regulations imposed on the transport of firearms.

The invention, of course, has been described by way of example and in limited fashion, so that any necessary changes in the structure of the details, such as, for example, the shape of the snug fits and in the system of the connecting elements are included in the scope of the technical solution described hereinabove and claimed hereinbelow.

I claim:

1. A break-open action for sporting rifles, the break open action comprising a forward part for connection with at least one rifle barrel, means for releasably locking the forward part with a rearward part including snug seat means and fastening means, the rearward part including lock means for connection with a rifle stock, and wherein said seat means enables an angular adjustment about an axis disposed in a plane of the snug seat means.

2. A break-open action according to claim 1, wherein the snug seat means provide a variable angle between longitudinal axes of the forward and rearward parts and between the barrel and the stock, and wherein the angle about which a contact surface common to both the forward and rearward parts is inclined with respect to a perpendicular plane toward a firing direction of the rifle.

* * * * *